US010711504B2

(12) United States Patent
Roos et al.

(10) Patent No.: US 10,711,504 B2
(45) Date of Patent: Jul. 14, 2020

(54) POWER DOOR PRESENTER WITH LATCHING FEATURE

(71) Applicant: Magna Closures Inc., Newmarket (CA)

(72) Inventors: Martin Roos, Oestrich-Winkel (DE); Francesco Cumbo, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 347 days.

(21) Appl. No.: 15/674,988

(22) Filed: Aug. 11, 2017

(65) Prior Publication Data

US 2018/0051502 A1 Feb. 22, 2018

Related U.S. Application Data

(60) Provisional application No. 62/375,623, filed on Aug. 16, 2016, provisional application No. 62/438,623, filed on Dec. 23, 2016.

(51) Int. Cl.

*E05F 15/622* (2015.01)
*E05B 81/00* (2014.01)
*E05F 15/614* (2015.01)

(52) U.S. Cl.

CPC ..... *E05F 15/622* (2015.01); *E05B 81/00* (2013.01); *E05F 15/614* (2015.01); *E05Y 2201/434* (2013.01); *E05Y 2201/702* (2013.01); *E05Y 2800/11* (2013.01); *E05Y 2900/531* (2013.01)

(58) Field of Classification Search

CPC ..... E05F 15/622; E05F 15/60; E05F 15/614; E05Y 2201/43; E05Y 2201/702; E05Y 2201/704; E05Y 2800/00; E05Y 2800/11; E05Y 2900/531; E05Y 2900/53; E05Y 2201/434

USPC ..... 292/201

See application file for complete search history.

(56) References Cited

U.S. PATENT DOCUMENTS

| | | | | |
|---|---|---|---|---|
| 9,174,517 | B2 | 11/2015 | Scheuring et al. | |
| 2003/0111863 | A1* | 6/2003 | Weyerstall | E05B 79/20 296/146.1 |
| 2003/0216817 | A1* | 11/2003 | Pudney | E05B 81/78 700/17 |
| 2010/0052337 | A1* | 3/2010 | Arabia, Jr. | E05B 81/82 292/216 |
| 2014/0150581 | A1* | 6/2014 | Scheuring | B60J 5/047 74/89.38 |

FOREIGN PATENT DOCUMENTS

| | | | |
|---|---|---|---|
| CN | 102677991 | A | 9/2012 |
| CN | 103132826 | A | 6/2013 |

(Continued)

OTHER PUBLICATIONS

First Office Action; Chinese Patent Appl. No. 201710702564.3; dated Apr. 9, 2020; 6 pages.

*Primary Examiner* — Nathan Cumar
(74) *Attorney, Agent, or Firm* — Dickinson Wright PLLC

(57) ABSTRACT

A power door actuation system for a vehicle door includes a power-operated presenter assembly fixed to one of the vehicle door and vehicle body and an auxiliary latch assembly fixed to the other one of the vehicle door and vehicle body. A latched relationship is maintained between the vehicle door and the vehicle body when the presenter assembly moves the door between a closed position and a deployed position.

18 Claims, 10 Drawing Sheets

(56) References Cited

FOREIGN PATENT DOCUMENTS

| | | | |
|---|---|---|---|
| CN | 103732845 | A | 4/2014 |
| DE | 3024230 | A1 | 1/1982 |
| JP | H07116878 | B2 | 12/1995 |
| JP | 2010006211 | A | 1/2010 |

* cited by examiner

POWER DOOR PRESENTER WITH LATCHING FEATURE

CROSS-REFERENCE TO RELATED APPLICATIONS

This application claims the benefit of U.S. Provisional Application No. 62/375,623, filed Aug. 16, 2016 and U.S. Provisional Application No. 62/438,623 filed Dec. 23, 2016. The entire disclosure of each of the above applications is incorporated herein by reference.

FIELD

The present disclosure relates generally to power door systems for motor vehicles. More particularly, the present disclosure is directed to a power door actuation system equipped with a power door presenter assembly operable for powered movement of a vehicle door relative to a vehicle body between a closed position and an open position and an auxiliary latch assembly for holding the vehicle door in a partially-open position.

BACKGROUND

This section provides background information related to the present disclosure which is not necessarily prior art.

The passenger doors on most motor vehicles are mounted by a pair of door hinges to the vehicle body for swinging movement about a generally vertical pivot axis. Such swinging passenger doors have recognized issues such as, for example, when the vehicle is situated on an inclined surface and the door either swings opens too far or swings shut due to the unbalanced weight of the door. To address this issue, most passenger doors have some type of detent or check mechanism integrated into at least one of the door hinges and which functions to inhibit uncontrolled swinging movement of the door by positively locating and holding (i.e. "checking") the door in one or more mid-travel positions in addition to its fully-open position.

In view of increased consumer demand for motor vehicles equipped with advanced comfort and convenience features, many current vehicles are now provided with passive keyless entry systems to permit locking and release of the passenger doors without the use of traditional key-type manual entry systems. In this regard, some of the more popular features now provided with vehicle closure systems include power locking/unlocking and power release. These "powered" features are typically integrated into a primary latch assembly mounted to the passenger door and which is configured to include a latch mechanism, a latch release mechanism and at least one electric actuator. As is known, movement of the passenger door to its closed position causes the latch mechanism to engage a striker (mounted to the vehicle body) and shift the primary latch assembly into a latched mode. To subsequently release the passenger door for movement from its closed position toward an open position, an electric "power release" actuator can actuate the latch release mechanism to mechanically release the striker from the latch mechanism and shift the primary latch assembly into an unlatched mode.

As a further advancement, power door actuation systems have been developed which function to automatically swing the passenger door about its pivot axis between its open and closed positions. Typically, power door actuation systems include a power-operated device such as, for example, a power swing door actuator having an electric motor and a rotary-to-linear conversion device that are operable for converting the rotary output of the electric motor into translational movement of an extensible member. In many power door actuator arrangements, the power swing door actuator is mounted to the passenger door and the distal end of the extensible member is fixedly secured to the vehicle body. One example of a door-mounted power door actuation system is shown in commonly-owned U.S. Pat. No. 9,174,517 with a power swing door actuator having a rotary-to-linear conversion device configured to include an externally-threaded leadscrew rotatively driven by the electric motor and an internally-threaded drive nut meshingly engaged with the leadscrew and to which the extensible member is attached. Accordingly, control over the speed and direction of rotation of the leadscrew results in control over the speed and direction of translational movement of the drive nut and the extensible member for controlling swinging movement of the passenger door between its open and closed positions. Operation of the power swing door actuator is controlled in coordination with the power release operation of the primary latch assembly via the passive keyless entry system.

Some other door actuation systems, known as door presenter systems, are configured to include a power-operated door presenter assembly operable to "present" the door by opening it only a predetermined amount (such as, for example, 30-50 mm) to a partially-open position so as to allow subsequent manual movement of the door to its fully-open position. The vehicle door is almost always retained in this partially-open or "presented" position, as mentioned above, by a door checking arrangement associated with one of the door hinges and/or incorporated into the power door presenter assembly.

Because the door presenter assembly is typically activated by the passive keyless entry system in conjunction with power release of the primary latch assembly, it would be beneficial to have a door presenter system configured to fully close the vehicle door in the event the user decides, once the door is deployed, to not open it. It would also be beneficial to provide a door presenter system configured to hold the door by the power-operated door presenter assembly, to move the door between its deployed and rest positions, and allow manual or power release of a holding mechanism associated with the door presenter assembly. It is also advantageous to overcome problems associated with current power door presenter systems in which the door can unintentionally open due to gravity forces and wind forces.

In view of the above, there remains a need to develop alternative power door presenter systems which address and overcome limitation associated with known power door actuation systems as well as to provide increased applicability while reducing cost and complexity.

SUMMARY

This section provides a general summary of the present disclosure and is not a comprehensive disclosure of its full scope or all of its features, aspects and objectives.

It is an aspect of the present disclosure to provide a power swing door actuation system for moving a vehicle door about a vertical axis between partially-open or deployed position and closed positions relative to a vehicle body.

In a related aspect, the power swing door actuation system for the vehicle door includes providing a power door presenter assembly and an auxiliary latch assembly configured to move and latch the vehicle door in its deployed position. An auxiliary latch mechanism associated with the auxiliary latch assembly cooperates in conjunction with an auxiliary striker to maintain the vehicle door in a latched condition during powered deployment resulting from actuation of the power door presenter assembly. The auxiliary latch mechanism is released (via power or manual operation) prior to subsequent movement of the door to its fully-open position.

In accordance with these and other aspects, a power swing door actuation system is provided for use in a motor vehicle having a vehicle body defining a door opening and a vehicle door pivotably connected to the vehicle body for swing movement about a vertical axis along a swing path between fully-open and closed positions relative to the door opening. The power swing door actuation system of the present disclosure includes a power door presenter assembly attached to one of the vehicle door and the vehicle body and an auxiliary latch assembly attached to the other one of the vehicle door and the vehicle body. The power door presenter assembly includes a push/pull striker connected to an extensible member of a motor-driven presenter actuator which interacts with a latch component (i.e. ratchet) of an auxiliary latch mechanism associated with the auxiliary latch assembly. An auxiliary latch release mechanism (manually or power operated) is arranged to move a release component (i.e. pawl) of the auxiliary latch mechanism from a first or "ratchet holding" position to a second or "ratchet releasing" position so as to permit subsequent movement of the latch component from a first or "striker capture" position into a second or "striker release" position following movement of the door to its deployed position as a result of actuation of the motor-driven presenter actuator. A release mechanism, such as a release cable connected to a power actuator or to a door handle, can be provided for manually actuating the auxiliary latch release mechanism. In addition to a power release mechanism, a mechanical back-up may be advantageous in the event of a power failure or emergency situation of the vehicle.

The power swing door actuation system of the present disclosure includes a power door presenter assembly attached to one of the vehicle door and the vehicle body having a motor-driven presenter actuator and an extensible member cooperating with a pivotable latch component of an auxiliary latch assembly to engage and retain an auxiliary striker mounted to the other one of the vehicle door and the vehicle body. An auxiliary latch release mechanism (manually or power operated) is arranged to pivot the latch component between a first or "auxiliary striker capture" position and a second or "auxiliary striker release" position following movement of the door to its deployed position. A power auxiliary latch release mechanism, such as a power release actuator connected to a cable, can be used to pivot the latch component of the auxiliary latch assembly in order to provide for engagement and disengagement of the auxiliary striker with the latch component. A back-up auxiliary latch release mechanism, such as a release cable connected to a door handle, can be used to pivot the auxiliary striker between its latched and released positions relative to the latch component located in its auxiliary striker capture position.

In accordance with both of the disclosed embodiments, the door presenter assembly functions to: provide door movement from a closed position to a deployed position within a predetermined range of swinging motion; allow subsequent unlatching of the auxiliary latching mechanism in order to move the door from its deployed position to its fully-open position after a voluntary action (e.g. power release by triggering a release sensor or manually actuating the release cable); allow the extensible member of the presenter assembly to be retracted from its deployed position; and allow the auxiliary latching mechanism to be re-engaged with the presenter assembly upon closing the door. It is recognized that the presenter assembly can be deployed in conjunction with either a cinch enabled or non-cinch enabled primary latch assembly.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION OF EXAMPLE EMBODIMENTS

In general, example embodiments of a power door actuation system constructed in accordance with the teachings of the present disclosure will now be disclosed. The example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, will-known device structures, and well-known technologies are described in detail.

Figure 1A:
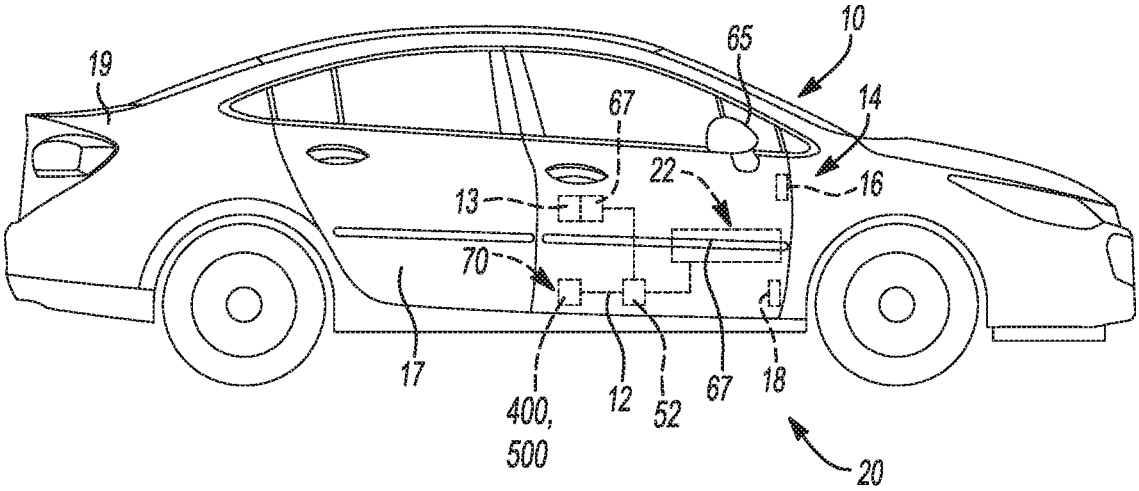
FIG. 1A illustrates an example motor vehicle equipped with a power door actuation system situated between a front passenger swing door and a vehicle body and which is configured to include a power swing door presenter assembly an an auxiliary latch assembly.

Referring initially to FIG. 1A, an example motor vehicle 10 is shown to include a first passenger door 12 pivotally mounted to a vehicle body 14 via an upper door hinge 16 and a lower door hinge 18 which are shown in phantom lines. In accordance with the present disclosure, a power door actuation system 20 is associated with the pivotal connection between first passenger door 12 and vehicle body 14. In accordance with a preferred configuration, power door actuation system 20 includes a power door presenter system 70, a vehicle door ECU 52, a primary latch assembly 13, and can also be configured with a power-operated swing door actuator 22 secured within an internal cavity of passenger door 12. The power swing door actuator 22 includes an electric motor driving an extensible component that is coupled to a portion of the vehicle body 14. Driven rotation of the electric motor causes translational movement of the extensible component which, in turn, controls pivotal movement of passenger door 12 relative to vehicle body 14.

Each of upper door hinge 16 and lower door hinge 18 include a door-mounting hinge component and a body-mounted hinge component that are pivotably interconnected by a hinge pin or post. While power door actuation system 20 is only shown in association with front passenger door 12, those skilled in the art will recognize that the power door actuation system can also be associated with any other door or liftgate of vehicle 10 such as rear passenger doors 17 and decklid 9.

Figure 1B:
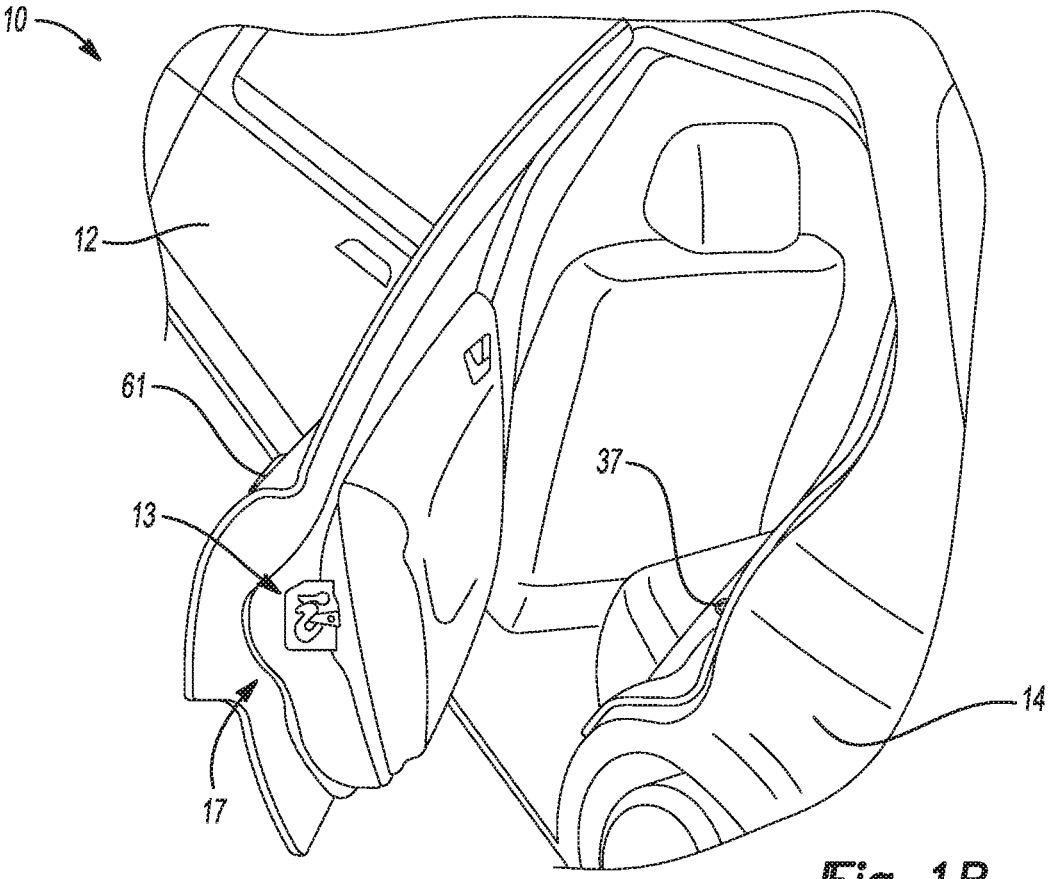
FIG. 1B is a view showing a primary latch assembly installed in the passenger swing doors associated with the vehicle shown in FIG. 1A.
Figure 1C:
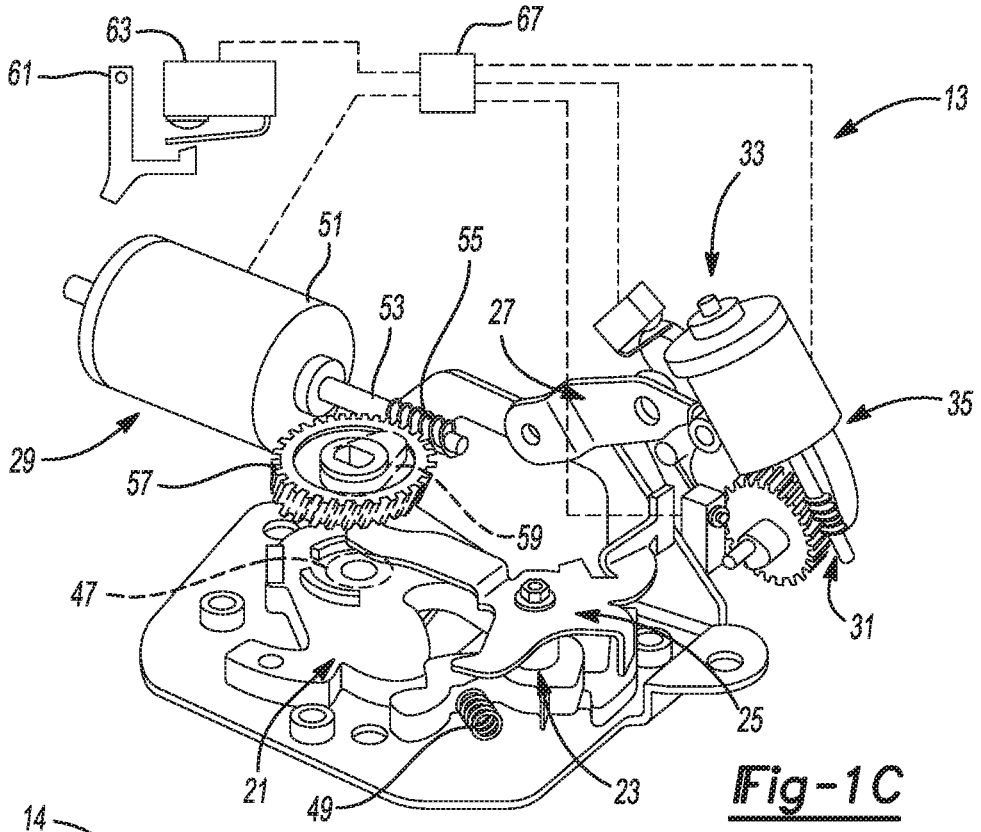
FIG. 1C illustrates an example embodiment of the primary latch assembly shown in FIG. 1B.

Referring to FIGS. 1B and 1C, shown is a non-limiting embodiment of a primary closure latch assembly 13 for vehicle doors 12, 17 of vehicle 10 (see FIG. 1A). Closure latch assembly 13 can be positioned on vehicle door 12, 17 and arranged in a suitable orientation to engage a striker 37, mounted on vehicle body 14, when door 12, 17 is closed. Closure latch assembly 13 includes a latch mechanism having a ratchet 21 and a pawl 23, a latch release mechanism having a pawl release lever 25, an inside door release mechanism having an inside release lever 27, a power release actuator 29 for controlling powered actuation of the latch release mechanism, and a power lock actuator 31 having a lock mechanism 33 and an electric lock motor 35. Ratchet 21 is movable between a two striker capture positions including primary or fully closed position (shown in FIG. 1C) and secondary or partially closed position (not shown) whereat ratchet 21 retains striker 37, and a striker release position (FIG. 1B) whereat ratchet 21 permits release of striker 37 from a fishmouth provided by a latch housing of latch assembly 13. Referring to FIG. 1C, a ratchet biasing member 47, such as a spring, is provided to normally bias ratchet 21 toward its striker release position. Pawl 23 is movable between a ratchet holding position (FIG. 1C) whereat pawl 23 holds ratchet 21 in its striker capture position, and a ratchet releasing position whereat pawl 23 permits ratchet 21 to move to its striker release position. A pawl biasing member 49, such as a suitable spring, is provided to normally bias pawl 23 toward its ratchet holding position.

Pawl release lever 25 is operatively connected to pawl 23 and is movable between a pawl release position whereat pawl release lever 25 moves pawl 23 to its ratchet releasing position, and a home position whereat pawl release lever 25 permits pawl 23 to be in its ratchet holding position. A release lever biasing member (not shown), such as a suitable spring, is provided to normally bias pawl release lever 25 toward its home position. Pawl release lever 25 can be moved to its pawl release position by several components, such as, for example, by power release actuator 29 and by inside door release lever 27. Power release actuator 29 includes a power release motor 51 having an output shaft 53, a power release worm gear 55 mounted on output shaft 53, and a power release gear 57. A power release cam 59 is connected for rotation with power release gear 57 and is rotatable between a pawl release range of positions and a pawl non-release range of positions. In FIG. 1C, power release cam 59 is located in a position that is within the pawl non-release range. Power release gear 57 is driven by worm gear 55 for driving cam 59 which, in turn, drives pawl release lever 25 from its home position into its pawl release position.

Power release actuator 29 can be used as part of a conventional passive keyless entry feature. When a person approaches vehicle 10 with an electronic key fob 60 (FIG. 2) and actuates an outside door handle 61, for example, sensing both the presence of key fob 60 and that door handle 61 has been actuated (e.g. via communication between a switch 63 (FIG. 1C) and an electronic latch control unit (ECU) shown at 67 (FIG. 1C) that at least partially controls the operation of closure latch assembly 13). In turn, latch ECU 67 actuates power release actuator 29 to cause the latch release mechanism to release the latch mechanism and shift primary closure latch assembly 13 into an unlatched operating state so as to facilitate subsequent opening of vehicle door 12. Also, power release actuator 29 can be used in association with power door actuation systems 20 and door presenter applications, as further describe below.

Power door actuation system 20 can include a power-operated swing door actuator 22 having the features of being typically mounted in door 12 and located near door hinges 16, 18; providing for full open/close movement of door 12 under actuation; providing an infinite door check function; and providing for manual override (via a slip clutch) of power-operated swing door actuator 22 as desired. Power operated swing door actuator 22 can function to automatically swing passenger door 12 about its pivot axis between its open and closed positions. Typically, power-operated swing door actuator 22 can include a power-operated device such as, for example, an electric motor and a rotary-to-linear conversion device that are operable for converting the rotary output of the electric motor into translational movement of an extensible member. In many power door actuation arrangements, the electric motor and the conversion device are mounted to passenger door 12 and a distal end of the extensible member is fixedly secured to vehicle body 14.

Figure 2:
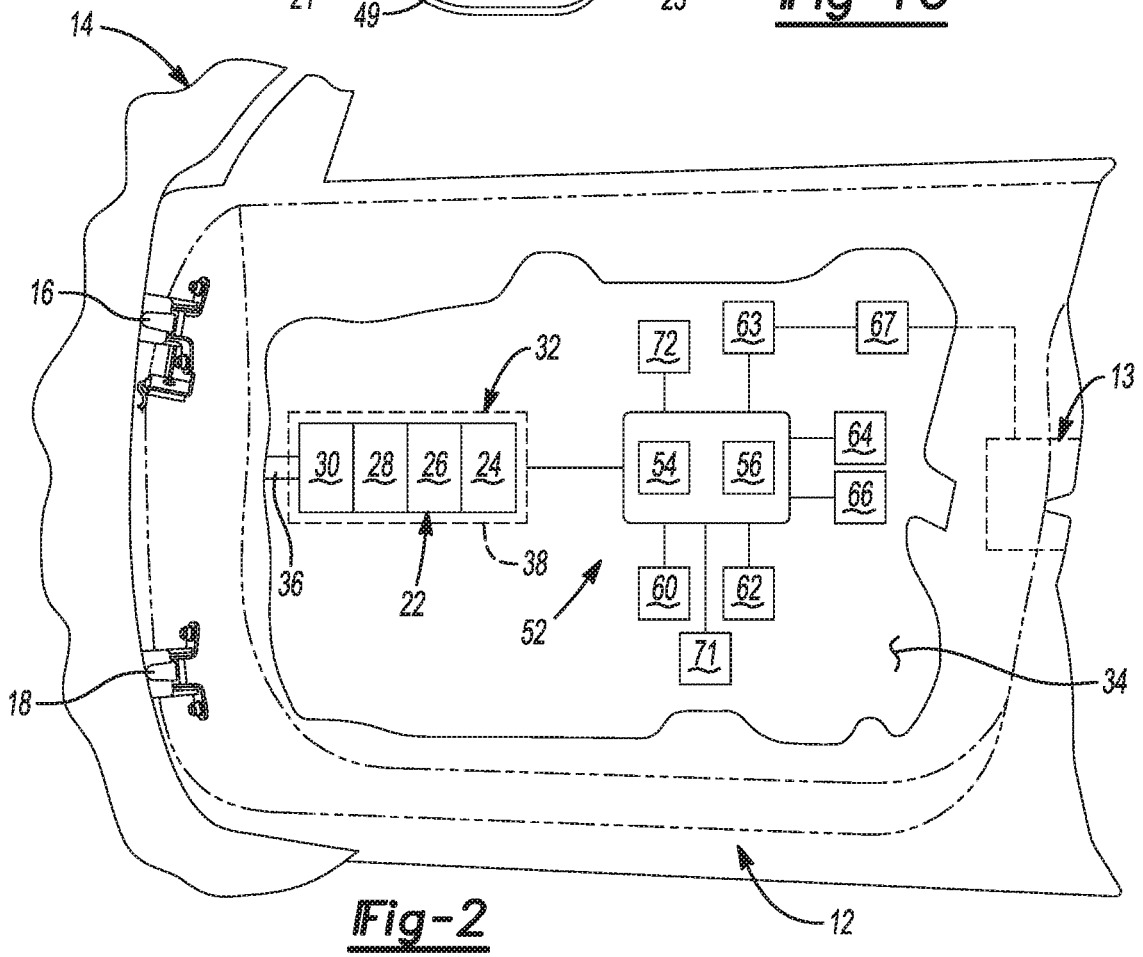
FIG. 2 is a diagrammatic view of the front passenger door shown in FIG. 1A, with various components removed for clarity purposes only, in relation to a portion of the vehicle body and which is equipped with the power door actuation system of the present disclosure.

Referring to FIGS. 1A and 2, in accordance with preferred configurations, a power door presenter system 70 (which can be configured for door 12 in conjunction with power-operated swing door actuator 22) generally includes a power-operated door presenter assembly 401, 501 secured within an internal cavity (e.g. preferably of vehicle body 14, or of passenger door 12, for example, and therefore associated with door 12) and including an electric motor driving a drive mechanism having an extensible component. Driven rotation of the drive mechanism causes controlled translation of the extensible component which, in turn, controls pivotal movement of passenger door 12 relative to vehicle body 14. The power-operated door presenter system 70 cooperates with an auxiliary striker latch assembly 402, 405 via a first embodiment of a power door presenter system 500. A second embodiment of door presenter system 70 is shown by reference numeral 400 of FIG. 7. As such, it is recognized that location of the power-operated door presenter systems 70, 400, 500 between vehicle body 14 and vehicle door 12 can be at any position, as shown by example or otherwise, as desired.

Accordingly, the presenter assembly of power door presenter system 70, as further explained below, can be located at the bottom of door 12 below primary latch assembly 13 opposite to door hinges 16, 18. Alternatively, the presenter assembly of power door presenter system 70 can be mounted to vehicle body 14 and an auxiliary latch/striker mechanism of power door presenter system 70 can be mounted to door 12. Power door presenter system 70 can also provide for a partial open/close movement of door 12. As such, actuation of power door presenter system 500 can provide for coordinated and controlled presentment of door 12 by power door presenter system 500 while also subsequently providing for release of the auxiliary latch striker 524 and manual opening of door 12 by the user.

As also shown, an electronic control module, hereinafter referred to as swing door ECU 52, is in communication with electric motor 24 for providing electric control signals thereto. Swing door ECU 52 can include a microprocessor 54 and a memory 56 having executable computer readable instructions stored thereon.

FIG. 2 shows one or more sensors 71 communicating with swing door ECU 52 for providing requisite information. It is recognized that sensors 71 can be any number of sensor types (e.g. Hall sensor, presence sensors such as anti-pinch strips, capacitive, ultrasonic, mechanical switches, location sensors, etc.). Although not expressly illustrated, electric motor 24 can include sensors for monitoring a position of vehicle door 12 during movement between its open and closed positions. As is also schematically shown in FIG. 2, swing door ECU 52 can be in communication with remote key fob 60 or an internal/external handle switch 62 for receiving a request from a user to open or close vehicle door 12. Put another way, swing door ECU 52 receives a command signal from either remote key fob 60 and/or internal/external handle switch 62 to initiate an opening or closing of vehicle door 12. It is also recognized that a body control module 72 (having memory with instructions for execution on a computer processor) mounted in body 14 of vehicle 10 can send the open or close request to swing door ECU 52 and electronic latch ECU 67.

It is recognized that other than outside handle switch 63, swing door ECU 52 can be in communication with a number of other sensors in the vehicle including in power-operated swing door actuator 22, in power door presenter system 70 and in primary latch assembly 13. For example, the switches of primary latch assembly 13 can provide information to latch ECU 67 as well as swing door ECU 52 (i.e. the switches provide positional information to swing door ECU 52 of the location/state of door 12 with respect to position at or between the fully closed or latched position, secondary or partially closed and the partially open or unlatched position). Obviously a single ECU can be used to integrate the functions of door ECU 52 and latch ECU 67 into a common control device located anywhere within door 12.

Swing door ECU 52 can also receive an additional input from an (e.g. ultrasonic) sensor 64 positioned on a portion of vehicle door 12, such as on a door mirror 65, or the like. Ultrasonic sensor 64 assesses if an obstacle, such as another car, tree, or post, is near or in close proximity to vehicle door 12. If such an obstacle is present, ultrasonic sensor 64 will send a signal to swing door ECU 52, and swing door ECU 52 will proceed to turn off electric motor 24 to stop movement of vehicle door 12, and thus prevent vehicle door 12 from hitting the obstacle.

Figure 3A:
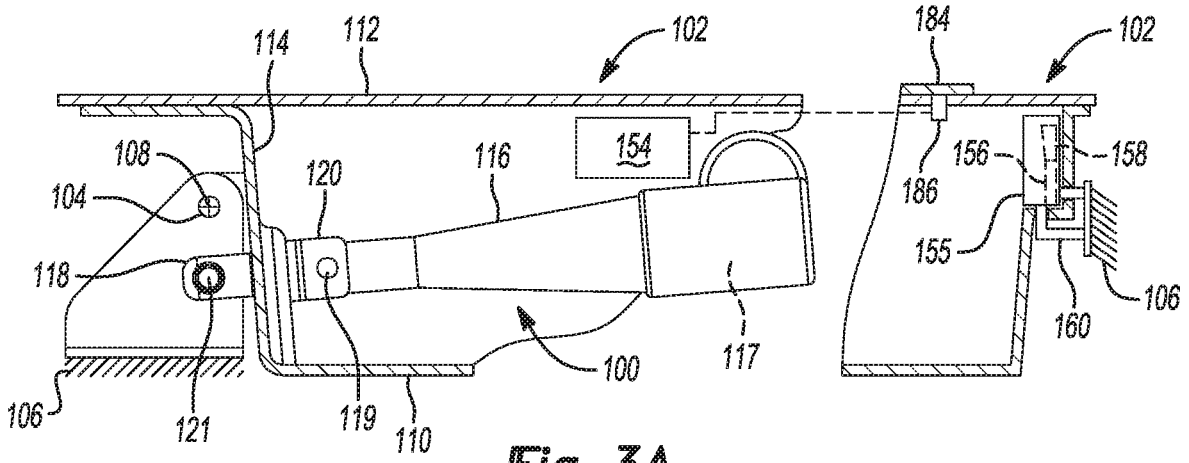
FIGS. 3A, 3B and 3C are schematic views of a power swing door actuator according to a first embodiment of the present disclosure and which is operably arranged between the vehicle body and the swing door for moving the swing door between a closed position, one or more partially-open positions, and a fully-open position, respectively.
Figure 3B:
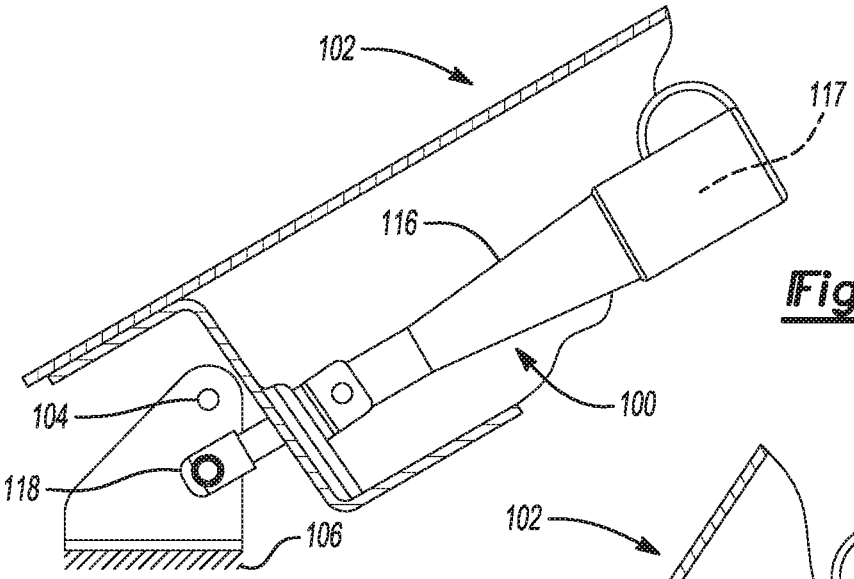
Figure 3C:
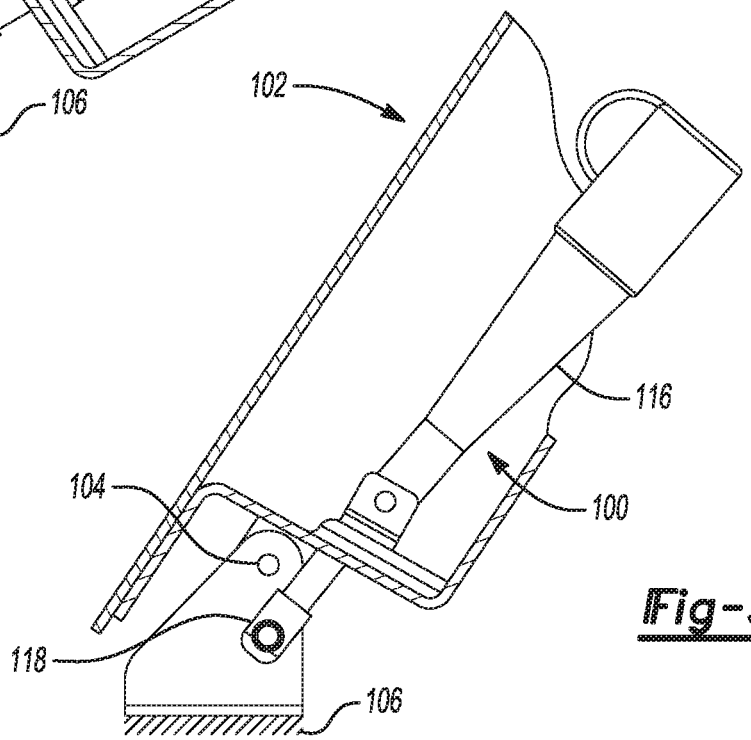

FIGS. 3A, 3B and 3C show an embodiment of a power swing door assembly 100 in operation to move a vehicular swing door 102 between a closed position, a mid-position, and an open position, respectively. The swing door 102 is pivotally mounted on at least one hinge 104 connected to the vehicle body 106 (not shown in its entirety) for rotation about a vertical axis 108. For greater clarity, the vehicle body 106 is intended to include the 'non-moving' structural elements of the vehicle such as the vehicle frame (not shown) and body panels (not shown).

The swing door 102 includes inner and outer sheet metal panels 110 and 112 with a connecting portion 114 between the inner and outer sheet metal panels 110 and 112. The power swing door assembly 100 has a housing 116 and an extensible member 118. The extensible member 118 is moveable between extended and retracted positions relative to housing 116. The power swing door assembly 100 may be mounted between the inner and outer sheet metal panels 110, 112, where the actuator housing 116 is fixed to the swing door via a bracket 120 mounted to the connecting door portion 114. The extensible member 118 is mounted to the vehicle body 106.

Figure 4:
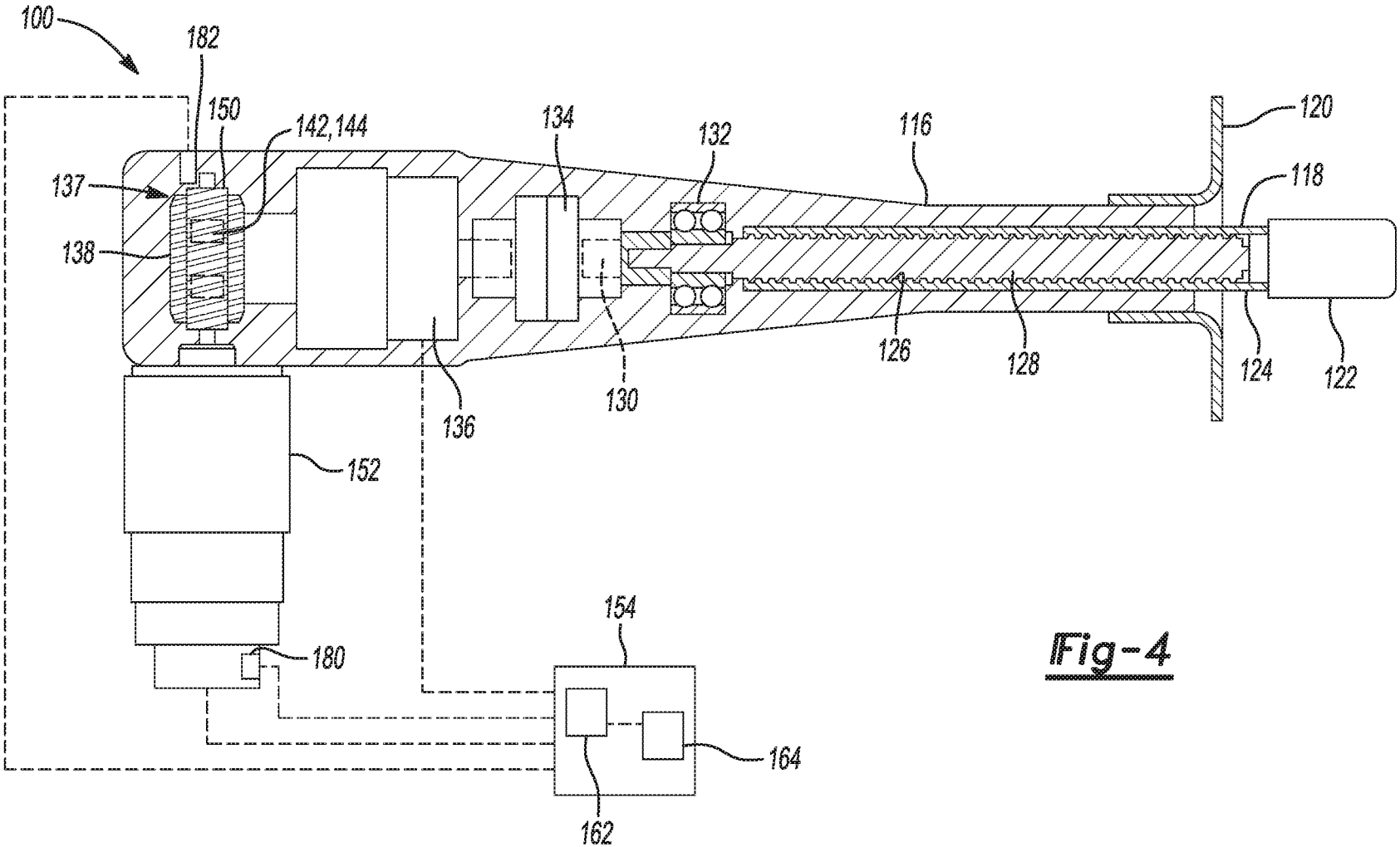
FIG. 4 is a sectional view of the power swing door actuator shown in FIGS. 3A, 3B and 3C.

Referring additionally to the cross-sectional view of the power swing door assembly 100 in FIG. 4, the housing 116 defines a cylindrical chamber in which the extensible member 118 slides. The extensible member 118 has a ball socket 122 at an external end thereof for attachment to the vehicle body 106. The ball socket 122 is connected to a cylindrical tube 124 which has an internal thread 126 proximate an internal end of the extensible shaft 118.

The internally threaded member 124 may be a cylindrical tube with an internal thread (and may be referred to as a nut tube) meshingly engages with a lead screw 128 mounted in the housing for rotation in situ. The lead screw 128 is matable with the internally threaded member 124 to permit relative rotation between lead screw 128 and the internally threaded member 124. In the embodiment shown, because the nut tube 124 is slidably connected in the housing 116 but is prevented from rotation, as the lead screw 128 rotates the nut tube 124 translates linearly, causing the extensible member 118 to move with respect to the housing 116. Since the extensible member 118 is connected to the vehicle body 106 and the housing 116 is connected to the swing door 102, movement of the extensible housing causes the swing door 102 to pivot relative to the vehicle body 106. The lead screw 128 and the nut tube 124 define a spindle-type rotary-to-linear conversion mechanism.

The lead screw 128 is rigidly connected to a shaft 130 that is journaled in the housing 116 via ball bearing 132 that provides radial and linear support for the lead screw. In the illustrated non-limiting embodiment, an absolute position sensor 134 is mounted to the shaft 130. The absolute position sensor 134 as known in the art translates lead screw rotations into an absolute linear position signal so that the linear position of the extensible member 118 is known with certainty, even upon power up. In alternative embodiments, the absolute linear position sensor 134 can be provided by a linear encoder mounted between the nut tube 124 and housing 116 which reads the travel between these components along a longitudinal axis.

The shaft 130 is connected to a clutch unit 136. The clutch unit 136 is normally engaged and is energized to disengage. In other words, the clutch unit 136 couples the lead screw 128 with a geartrain unit 137 without the application of electrical power and the clutch unit 136 requires the application of electrical power to uncouple the lead screw 128 from the geartrain unit 137. The clutch unit 136 may engage and disengage using any suitable type of clutching mechanism, such as a set of sprags, rollers, a wrap-spring, a pair of friction plates, or any other suitable mechanism. As such, the slip clutch 136 can be used in the power door presenter assemblies to inhibit abuse loading of the electric motor of the power door presentment system 400, 500 (e.g. in the event that obstacles by the door 12 are encountered during operation of the electric motor of the power door presentment system 400, 500).

Swing door actuation system 20 includes the power swing door assembly 100 and a swing door control system 154. The swing door control system 154 may also be operatively connected to a primary latch assembly 155 (FIG. 3A), similar to primary latch assembly 13, which is provided as part of the swing door 102. Door latch 155 can include a ratchet 156 and a pawl 158 both of which can be any suitable ratchet and pawl known in the art and similar in operation to the arrangement shown in FIG. 1C. The ratchet 156 is movable between a closed position or any other primary or secondary closed position as is known in the art, wherein the ratchet 156 holds the striker 37 that is mounted to vehicle body 14 and an open position wherein the striker 37 is not held by the ratchet 156. When the ratchet 156 is in its primary closed position, the door latch 155 can be said to be closed. When the ratchet 156 is in its open position, the door latch 155 can be said to be open or somewhere in-between the open and closed positions. The pawl 158 is movable between a ratchet locking position wherein the pawl 158 holds the ratchet 156 in its closed position and a ratchet release position wherein the pawl 158 permits movement of the ratchet 156 to its open position. Any other suitable components may be provided as part of the door latch 155, such as components for locking and unlocking the door 12, and motors for causing movement of the pawl 158 between its ratchet locking and ratchet release positions, for example known as power release or for causing movement of the ratchet 156 between the secondary closed position and the primary closed position known as cinch.

The swing door 102 may have a conventional opening lever located inside the passenger compartment for manually opening the door latch 155. This opening lever can trigger a switch 62 connected to the swing door control system 154 such that, when the switch 62 is actuated, the swing door control system 154 facilitates that the power door presenter system 400, 500 is disengaged (i.e. is unhooked from the auxiliary latch) from the door 12 and thus facilitates manual movement of the door 12 by the user.

A first non-limiting embodiment of system 400 will now be described with reference to FIGS. 5 through 7 to generally include a power door presenter assembly 402 and an auxiliary latch assembly 401 having an auxiliary latch mechanism 404 and an auxiliary latch release mechanism 406. In general, presenter assembly 402 is adapted to be rigidly secured to vehicle body 14, such as by an actuator housing 410. Presenter assembly 402 is configured as a power-operated actuator including a motor-driven mechanism 412 having an electric motor 414 driving a reduction geartrain 416 for rotatably driving an externally-threaded leadscrew 418. An extensible member 421 (also referred to as a push tube or member), comprised of an internally-threaded nut 420 and an auxiliary striker 422, is non-rotatably and axially moveable on leadscrew 418 between a retracted position (FIG. 6) and an extended position (FIG. 7) relative to housing 410. When auxiliary striker 422 is located in its retracted position, vehicle door 12 is located in its closed position with primary closure latch assembly 13 operating in its latched state. In contrast, when auxiliary striker 422 is located in its extended position, door 12 is in a deployed or "presented" position. Auxiliary striker 422, as part of the extensible member 421, can move through a controlled range of bi-directional axial travel to permit corresponding movement of door 12 relative to vehicle body 14 between its closed and presented positions.

Figure 7:
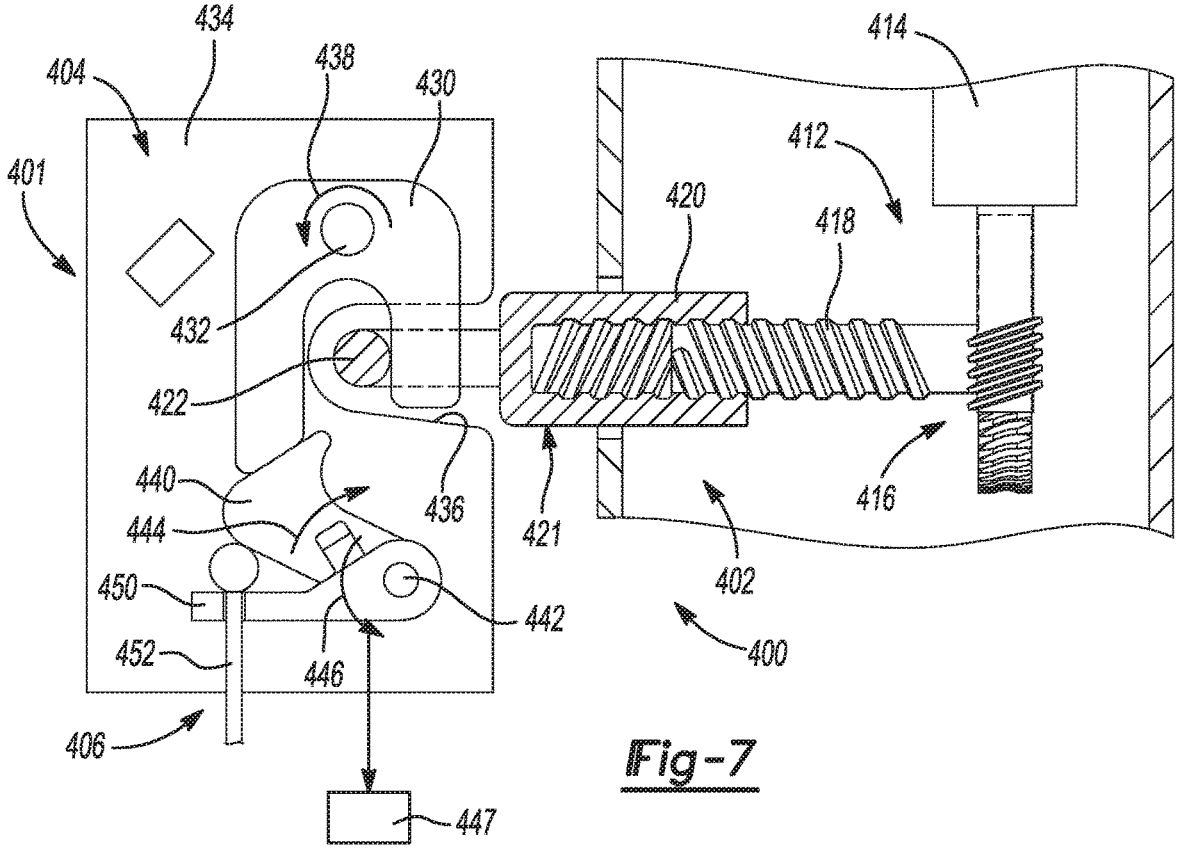
FIG. 7 is an enlarged view of the auxiliary latch assembly associated with the power door actuation system shown in FIG. 5.

As best seen in FIG. 7, the auxiliary latch assembly 401 is configured to be rigidly secured to vehicle door 12 and includes an auxiliary latch mechanism 404 having a latch component, such as a ratchet 430, that is pivotable about a ratchet pivot 432 on a latch housing 434 between an auxiliary striker capture position (FIG. 7) and an auxiliary striker release position. Latch housing 434 defines a fishmouth 436 which functions in conjunction with ratchet 430 to retain auxiliary striker 422 therein when ratchet 430 is located in its striker capture position. Ratchet 430 is normally biased toward its striker release position, as indicated by arrow 438. Auxiliary latch mechanism 404 also includes a hold/release component, such as a pawl 440, that is pivotably attached to latch housing 434 about a pawl pivot 442 for movement between a ratchet holding position (FIG. 7) and a ratchet releasing position. Pawl 440 is normally biased toward its ratchet holding position, as indicated by arrow 444. Auxiliary latch assembly 401 also includes an auxiliary latch release mechanism and an auxiliary latch release actuator, schematically identified by arrows 446 and block 447, which is operable to cause powered movement of pawl 440 from its ratchet holding position into its ratchet releasing position so as to allow ratchet 430 to move to its striker release position, thereby shifting auxiliary latch mechanism 404 from its latched mode into its unlatched mode. The power-operated auxiliary latch release mechanism 446 can act directly on pawl 440 or can be indirectly connected to auxiliary latch mechanism 404 via manual release mechanism 406. Auxiliary latch release actuator 447 can include an electric latch release motor arranged to directly or indirectly control movement of pawl 440. Note that auxiliary latch mechanism 404 and auxiliary striker 422 function as an auxiliary door retention device that is used in conjunction with an otherwise conventional primary door latch 13 (see FIG. 1A). Specifically, upon release of the primary door latch 13, presenter assembly 402 may be actuated while auxiliary striker 422 is retained by auxiliary latch mechanism 402 so as to deploy door 12 from its fully-closed position to its presented positions. Only after door 12 has reached its presented position, upon indication of presence of the user in manual control of door 12 via one or more presence sensors reporting to swing door ECU 52, is power-operated auxiliary release actuator 447 actuated to cause auxiliary latch release mechanism 446 to release auxiliary striker 422 from auxiliary latch mechanism 404.

Auxiliary release mechanism 406, used for manual (or powered) release, is shown to include a release lever 450 engaging pawl 440 and a release cable 452 having a first end connected to release lever 450 and a second end which can be connected to a door-mounted handle 454 or to a component of power-operated release actuator 446. Actuation of auxiliary release mechanism 406 causes release lever 450 to forcibly move pawl 440 from its ratchet holding position to its ratchet releasing position, thereby unlatching auxiliary latch mechanism 404. As such, back up release of the auxiliary latch mechanism 404 (rather than directed through swing door ECU 52) can be provided in the event of a power failure of the vehicle 10.

Figure 5:
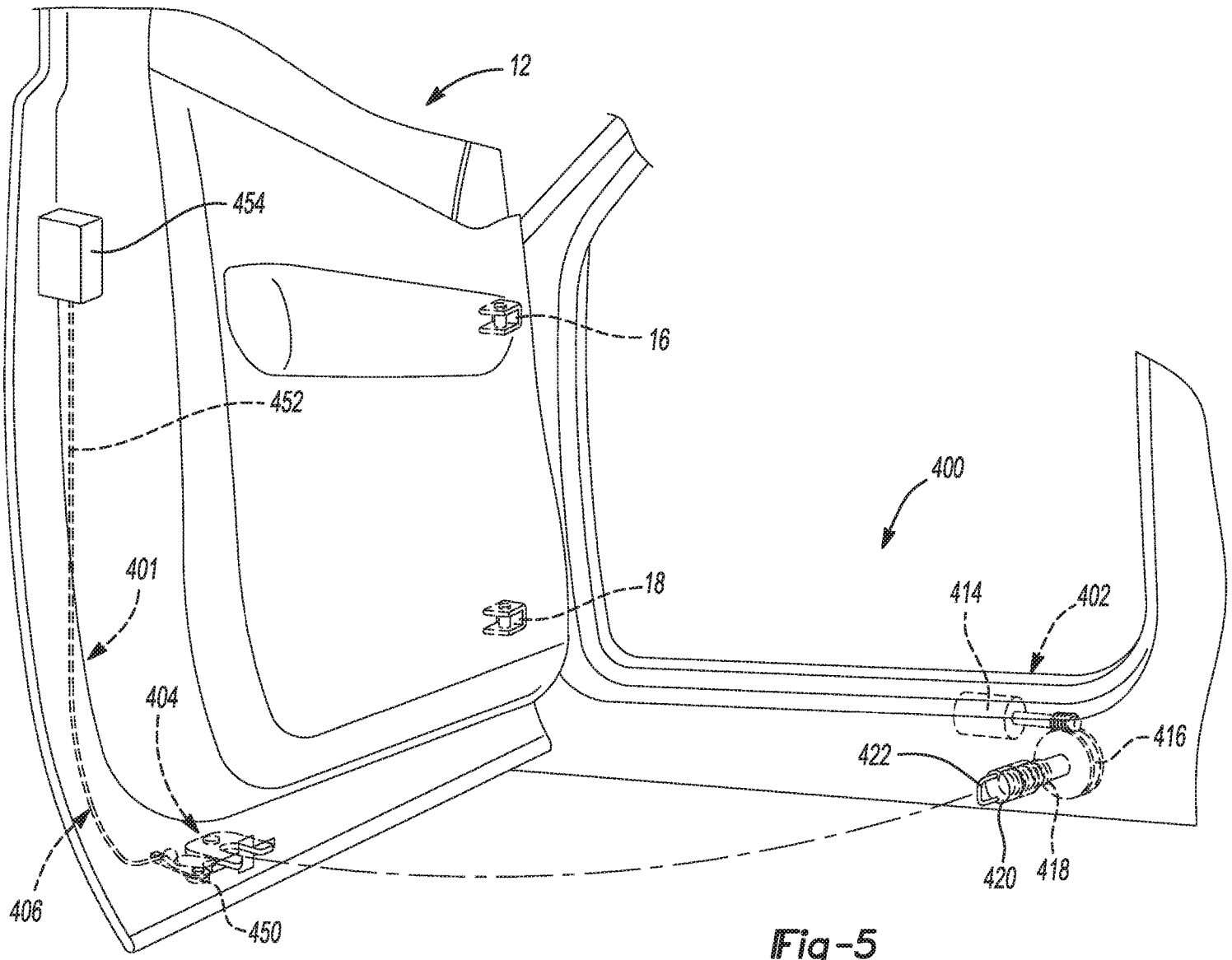
FIG. 5 illustrates the power door presenter system of FIG. 1A in accordance with a first embodiment.
Figure 6:
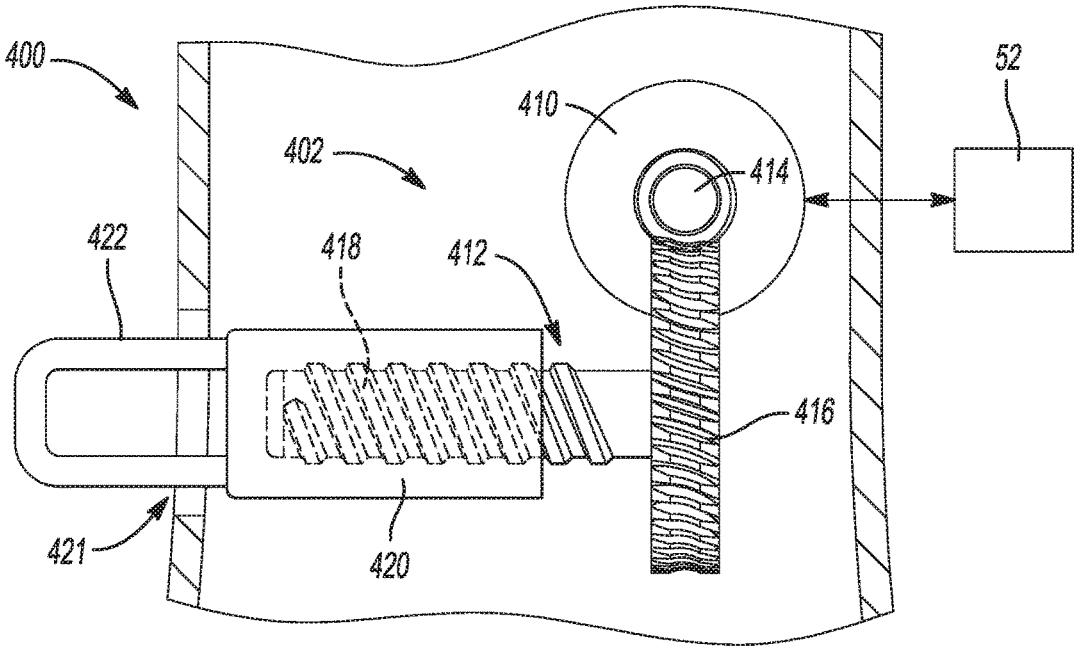
FIG. 6 is an enlarged view of the presenter assembly of the power door actuation system shown in FIG. 5.

Thus, power door presenter system 400 of FIGS. 5-7 employs a translating auxiliary striker 422, in association with the body-mounted presenter assembly 402, which can be selectively latched and unlatched relative to a pawl and ratchet type of auxiliary latching arrangement associated with auxiliary latch mechanism 404 mounted to vehicle door 12. This embodiment is not intended to be limited to this particular arrangement as it is contemplated that presenter assembly 402 could be installed in door 12 and auxiliary latch assembly 401 could be installed in vehicle body 14.

Figure 11:
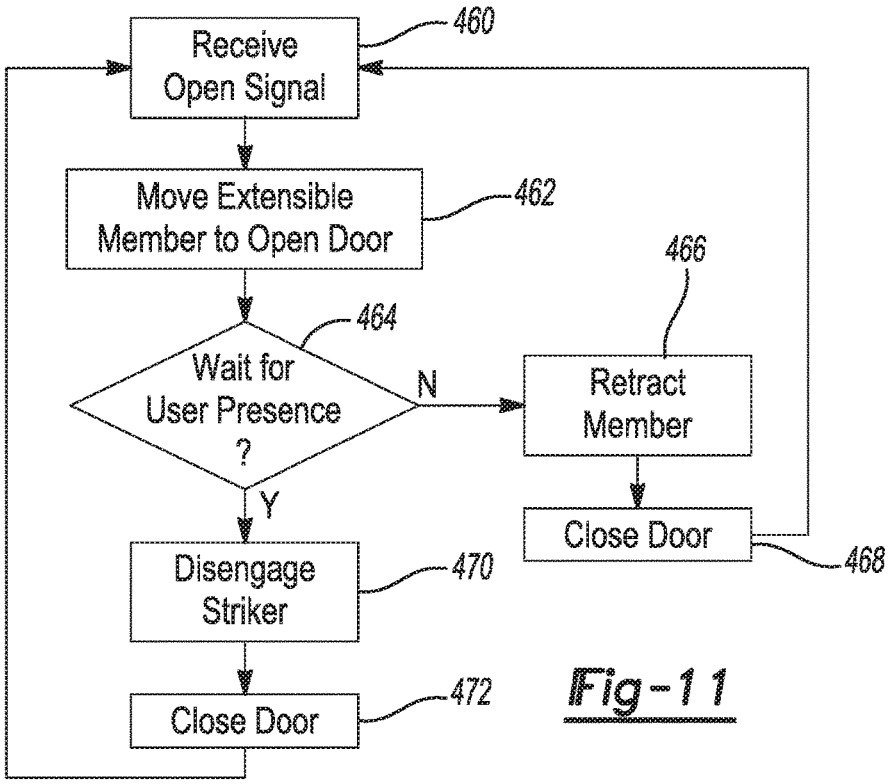
FIG. 11 is a flowchart for operation of the power door presenter system of FIGS. 5-7.

An example operation of the embodiment of power door presenter system 400 is shown in the flowchart of FIG. 11. As shown, swing door ECU 52 is in communication with electric motor 414 for providing electric control signals thereto. Swing door ECU 52 can include microprocessor 54 and memory 56 having executable computer readable instructions stored thereon for implementing the control logic stored as a set of computer readable instructions in memory 54 for operating the power door presenter system 400.

Shown by example, power door presenter system 400 can include sensors 71 (e.g. Hall-effect) for monitoring a position and speed of vehicle door 12 during movement between its partially open and closed positions. For example, one or more Hall-effect sensors 71 may be provided and positioned on power door presenter system 400 to send signals to swing door ECU 52 that are indicative of rotational movement of electric motor 414 and indicative of the rotational speed of electric motor 414, e.g., based on counting signals from the Hall-effect sensor 71 detecting a target on a motor output shaft. In situations where swing door ECU 52 is in a power open or power close mode and the sensors 71 indicate that a speed of electric motor 414 is less than a threshold speed (e.g. zero) and a current spike is registered, swing door ECU 52 can determine that an obstacle is in the way (e.g. presenter obstacle detection) of vehicle door 12, in which case the electronic control system can take any suitable action, such as sending a signal to turn off electric motor 414. As such, swing door ECU 52 can receive feedback from the sensors 71 to provide that a contact obstacle has not occurred during movement of vehicle door 12 from the closed position to the presented position, or vice versa. It is also recognized that the sensors 71 can include presence sensors (e.g. detecting the presence of a hand of the user), in order to detect that the user has manual control of the door 12 (e.g. is holding the door 12).

As is also schematically shown in FIG. 2, swing door ECU 52 can be in communication with remote key fob 60, main vehicle control module (also referred to as the body control module BCM 72), or internal/external handle switch 63 for receiving a request from a user to open or close vehicle door 12. Put another way, swing door ECU 52 receives a command signal from either remote key fob 60, BCM 72 and/or handle switch 63 to initiate an opening or closing of vehicle door 12. In one embodiment, operation of remote key fob 60 (or BCM 72 or external door handle 61) by the user can act as the signal to swing door ECU 52 to release primary latch assembly 13 and then start extension of extensible member 421 via energization of electric motor 414. Alternatively, operation of the internal handle of door 12 by the user can be regarded by swing door ECU 52 as a signal to release the power door presenter system 400 from the auxiliary latch mechanism 404, and maintain power door presenter system 400 in a retracted or home state during opening of door 12 by the user from inside of vehicle 10. It is recognized that alternatively, power door presenter system 400 can operate following activation from the inside of the vehicle 10 if desired.

Upon receiving a present command, swing door ECU 52 can provide a signal to electric motor 414 in the form of a pulse width modulated voltage (for speed control) to turn on motor 414 and initiate pivotal opening movement of vehicle door 12 towards its partially open deployed position (recognizing that primary latch assembly 13 is already in its unlatched state as further discussed below) via extension of extensible member 421. While providing the signal, swing door ECU 52 can also obtain feedback from sensors 71 to provide that contact with an obstacle has not occurred or otherwise that the user is present (e.g. is manually in charge of door 12). If no obstacle is present, motor 414 will continue to generate a rotational force to actuate spindle drive mechanism and thus extension of extensible member 421 until certain door positions are reached (e.g. 50 mm open position) or otherwise indicate that the user is present (e.g. hand is on the partially open door 12). Once vehicle door 12 is positioned at the desired location, motor 414 is turned off. If the user does not take control of door 12, then auxiliary latch mechanism 404 remains latched and vehicle door 12 can be automatically closed again by swing door ECU 52 using door presenter system 400, as further described below. Otherwise, upon signaling of manual control of door 12 by the user, auxiliary latch mechanism 404 is released by swing door ECU 52 actuating release actuator 446, 447 and door 12 is detached from door presenter system 400, as further described below.

Swing door ECU 52 can also receive an additional input from sensor 64 positioned on a portion of vehicle door 12, such as on door mirror 65, or the like. Sensor 64 assesses if an obstacle, such as another car, tree, or post, is near or in close proximity to vehicle door 12. If such an obstacle is present, sensor 64 will send a signal to swing door ECU 52, and swing door ECU 52 will proceed to turn off electric motor 414 to stop movement of vehicle door 12, and thus inhibit vehicle door 12 from hitting the obstacle. This provides a non-contact obstacle avoidance system. In addition, or optionally, an obstacle avoidance system can be placed in vehicle 10 which can include a contact sensor 66 mounted to door 12, such as in association with molding component 67, and operable to send a signal to swing door ECU 52.

Referring to FIG. 11, a method of operating door presenter system 400 is disclosed. Specifically, at step 460, swing door ECU 52 receives a signal for opening of door 12. If the signal is indicative of coming from inside of vehicle 10 (e.g. via internal door handle/button operation), door 12 is operated as a conventional door 12, once swing door ECU 52 sends a signal to auxiliary release actuator 446, 447 to open auxiliary latch mechanism 404 (i.e. providing for ratchet 430 to move to its striker release position). In an alternative embodiment, door presenter system 400 may be operated based on a signal for opening the door 12 from the inside (or outside) of vehicle 10. In the case with power door presenter system 400 is configured to provide an ice breaker function to break through any ice build-up around the door 12 which may prevent the door 12 from moving away from its closed position. Further, at step 460, electric motor 414 is not actuated and power door presenter system 400 remains in the disengaged state (i.e. auxiliary striker 422 is uninhibited by ratchet 430), thus facilitating opening of door 12 manually by the user. It is recognized that at step 460, primary latch assembly 13 is released (e.g. via a powered or manual release) in order for door 12 to be opened by the user. Upon closing of door 12, auxiliary latch mechanism 404 is latched when ratchet 21 of primary latch assembly 13 reaches its primary striker capture position (with or without cinch).

If the signal is indicative of coming from outside of vehicle 10 (e.g. key fob operation), swing door ECU 52 at step 462 maintains capture of auxiliary striker 422 by auxiliary latch mechanism 404 and signals electric motor 414 for operation such that extensible member 421 moves door 12 outboard from its closed position to its deployed presenter position (e.g. to a first check link detent position measured at for example 50 mm from the pillar to the trailing edge of door 12) by pushing on door 12 (e.g. pushing auxiliary striker 422 towards auxiliary latch mechanism 404 as extensible member 421 extends via operation of electric motor 414). It is recognized that primary latch assembly 13 can be operated by latch controller 67 or swing door ECU 52 (or by another vehicle control module—not shown) to become unlatched (e.g. placed into its unlatched state) prior to operation of power door presenter system 400, thus facilitating an opening movement (i.e. presentment) of the door 12 by power door presenter system 400 when primary latch assembly 13 is in its unlatched state. It is also recognized that latch pawl 23 can be maintained in the disengaged position (the power release motor 414 is not "reset" or returned to the home position) until extensible member 421 has opened door 12 sufficient travel or distance such that ratchet 21 is disengaged from striker 37 (i.e. door 12 is in open position). It is recognized that other than handle switch 63, swing door ECU 52 can be in communication with a number of other switches 71 in, or associated with, primary latch assembly 13. For example, these switches of primary latch assembly 13 can provide information to swing door ECU 52 of door 12 position (i.e. switches 71 provide positional information to swing door ECU 52 of the location/state of door 12 with respect to position at or between the fully closed or latched position and the unlatched position). In other words, swing door ECU 52 is aware of door 12 position (primary vs. secondary vs. closed) from the position switches of (e.g. inside) primary latch assembly 13 and can initiate/execute commands (primary latch reset, for example) based upon.

Once presented, at step 464, swing door ECU 52 waits for a specified period of time to receive a signal from the sensors representing that the user has control (e.g. is manually moving) of door 12. In this case, the sensors can be preferably an anti-pinch strip type sensor that runs the periphery of the door and is activated by contact when manually grabbing door 12, however activation of a manual switch or via a capacitive, ultrasonic, or other contact or non-contact sensor can also be used. If no signal (e.g. change of state) is received from the sensors, then swing door ECU 52 at step 466 signals electric motor 414 to retract extensible member 421 (while ratchet 430 and auxiliary striker 422 are engaged) in order to pull door 12 to the secondary latch position, for example. At step 468, a cinching mechanism of primary latch assembly 13 can close door 12 and door 12 is returned to the primary closed position. Alternatively, extensible member 421 can pull door 12 to the primary closed position of primary latch assembly 13. Accordingly, power door presenter system 400 is ready for reactivation at step 460.

Otherwise, if at step 464 the sensors provide a signal to swing door ECU 52 that door 12 is under the manual control of the user, then a change of state is detected (i.e. operator opens door). Swing door ECU 52 signals at step 470 auxiliary release actuator 446 to disengage ratchet 430 and auxiliary striker 422. At step 472, swing door ECU 52 sends a retraction signal to electric motor 414 in order to fully retract extensible member 421 to its home position (e.g. non-extended position). Upon closing of door 12 by the user (e.g. manually) at step 472, in order to close primary latch assembly 13, auxiliary striker 422 would once again become engaged with ratchet 430 of auxiliary latch mechanism 404 (i.e. reset ratchet 430 such that ratchet 430 is held by pawl 440 and auxiliary striker 422 is retained by ratchet 430 in the fishmouth 436. Accordingly, power door presenter system 400 is ready for reactivation at step 460.

Figure 8:
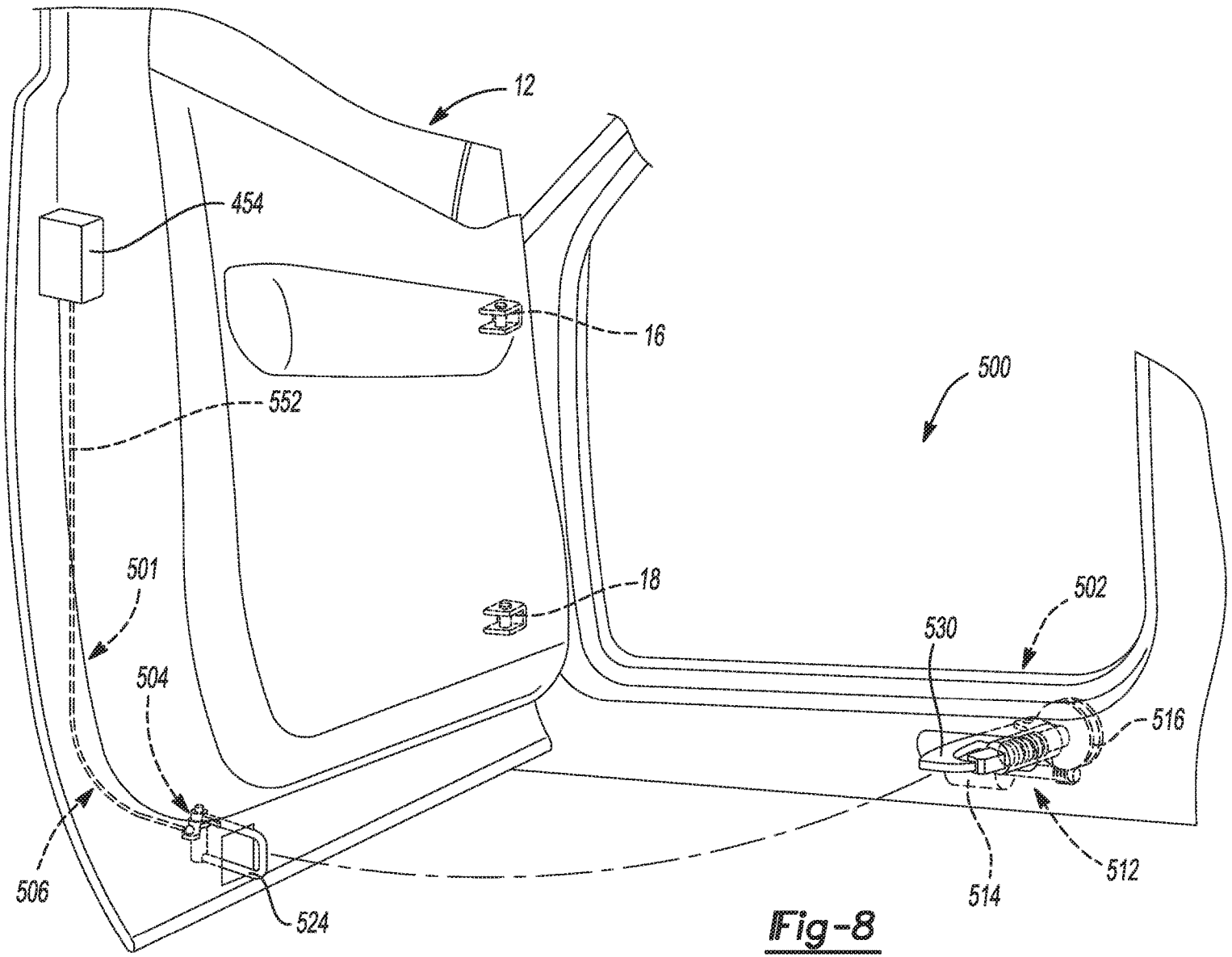
FIG. 8 illustrates a power door actuation system for use in the vehicle of FIG. 1A, but which is now configured in accordance with a second embodiment of the present disclosure.
Figure 9:
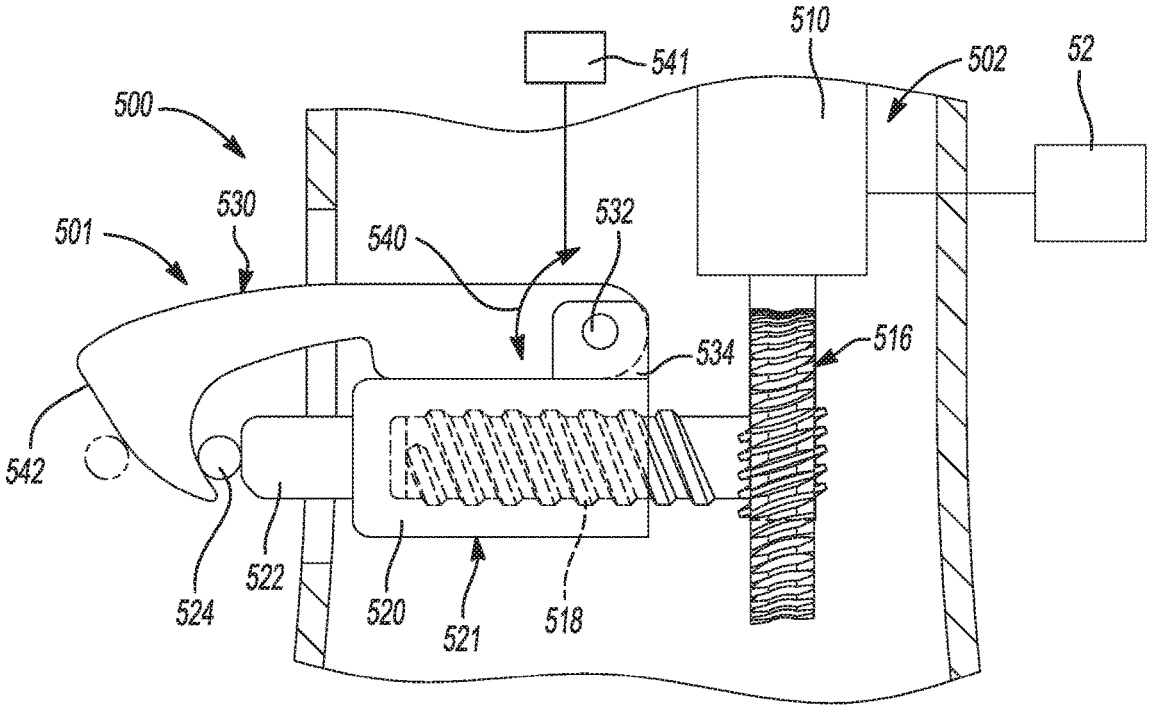
FIG. 9 is an enlarged view of the presenter assembly associated with the power door actuation system of FIG. 8.
Figure 10:
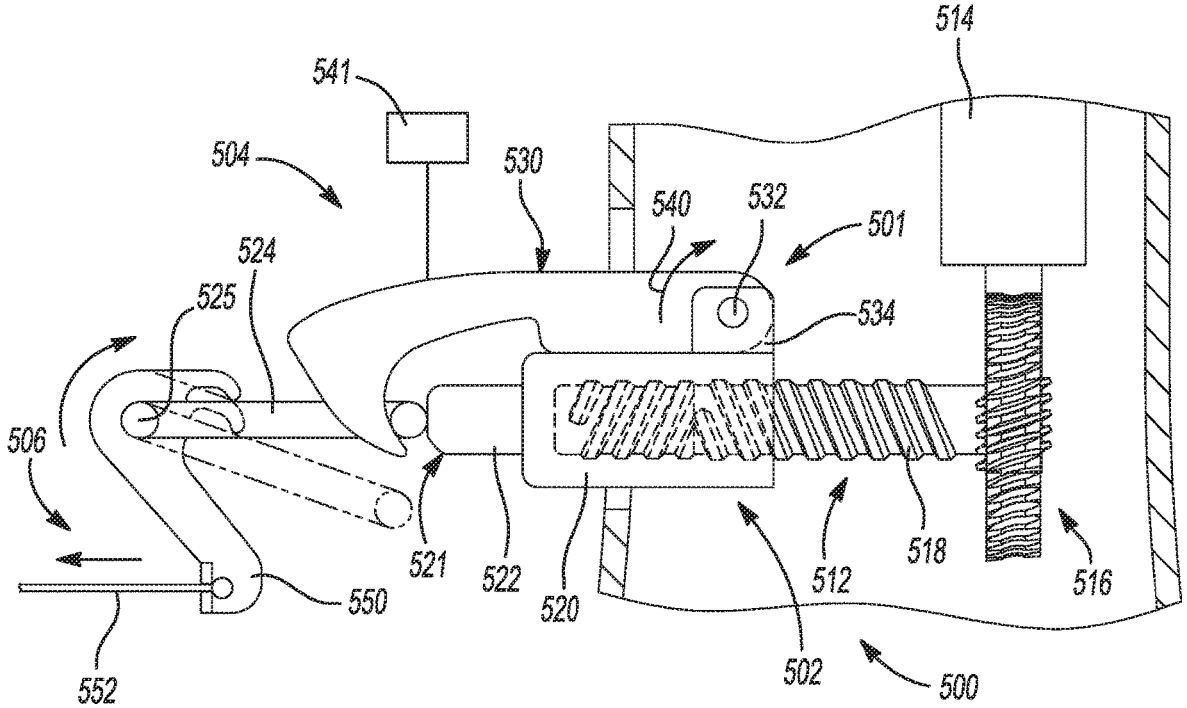
FIG. 10 is an enlarged view of the auxiliary latch assembly associated with the power door actuation system of FIG. 8.

Referring now to FIGS. 8-10, an alternative embodiment of a power door presenter system 500 is shown for use with vehicle 10 in substitution for presenter system 400 of FIGS. 5-7. In this arrangement, system 500 generally includes a power door presenter assembly 502 and an auxiliary latch assembly 501 having an auxiliary latch mechanism 504 and an auxiliary latch release mechanism 506. Presenter assembly 502 is adapted to be fixed to vehicle body 14, such as by an actuator housing 510. Presenter assembly 502 includes a motor-driven spindle mechanism 512 having an electric motor 514 driving a reduction geartrain 516 for rotatably driving an externally-threaded leadscrew 518. An extensible member 521, comprised of an internally-threaded drive nut 520 having an auxiliary striker abutment 522, is axially moveable on leadscrew 518 between a retracted position (FIG. 9) and an extended position (FIG. 10). When auxiliary striker abutment 522 engages a door-mounted auxiliary striker 524 with extensible member 521 in its retracted position, door 12 is fully closed. In contrast, positioning of auxiliary striker abutment 522 when extensible member 521 is in its extended position (still engaging auxiliary striker 524) results in movement of door 12 to its deployed position. Extensible member 521 can move, relative to housing 510, through a controlled range of bi-directional axial travel to permit corresponding movement of door 12 relative to vehicle body 14.

As best seen from FIGS. 9 and 10, power door presenter 502 includes, in addition to extensible member 521, a latch hook 530 that is pivotably connected via a pivot 532 to a lug portion 534 of drive nut 520. Latch hook 530 is moveable between an auxiliary striker capture position (FIGS. 9 and 10) and an auxiliary striker release position. Latch hook 530 is biased by a latch hook spring (not shown) toward its auxiliary striker capture position. Auxiliary latch assembly 501 also includes a power-operated auxiliary release actuator, schematically identified by arrow 540 and block 541. Power-operated auxiliary latch release mechanism 540 and an auxiliary release actuator 541 are operable to move latch hook 530 from a latched position (shown) to an unlatched position so as to release auxiliary striker 524 from latched engagement therewith. Again, the release of auxiliary striker 524 from retention within latch hook 530 is coordinated following the release of primary door latch assembly 13 and movement of door 12 via actuation of door presenter assembly 502 to its deployed position as will be further described below. Auxiliary latch mechanism 504 can include door-mounted auxiliary striker 524 being mounted on pivot 525 for movement between a hook capture and a hook release position.

Auxiliary release mechanism 506, used for manual or power release, is shown to include a release lever 550 engaging auxiliary striker 524, and a release cable 552 having a first end connected to release lever 550 and a second end that can be connected to handle 454 or a release actuator 541. As seen, auxiliary striker 524 can be pivotably mounted to door 12 for movement about pivot 525 between a striker latched (also referred to as hook capture) and a striker unlatched (also referred to as a hook release) position (shown in phantom in FIG. 10). Actuation of handle 454 or the like causes release lever 550 to move auxiliary striker 524 from its striker latched position into its striker unlatched position, thereby releasing auxiliary striker 524 from latch hook 530. As a further alternative, power-operated auxiliary release actuator 540, 541 could be configured to cooperate with pivotable auxiliary striker 524 instead of latch hook 530 to provide the power release function. It is recognized that similar to the above described power door presenter system 400, power door presenter system 500 can also be configured for back up release in the event of a power failure (e.g. disabled swing door ECU 52) for vehicle 10 via a manually-operated auxiliary release mechanism. Latch hook 530 has an outer cam surface 542 configured to move latch hook 530 from its normal auxiliary striker capture position, against the biasing of the latch hook spring, in response to engagement with auxiliary striker 524 upon closing of door 12 so as to cause re-engagement of auxiliary striker 524 with latch hook 530.

Figure 12:
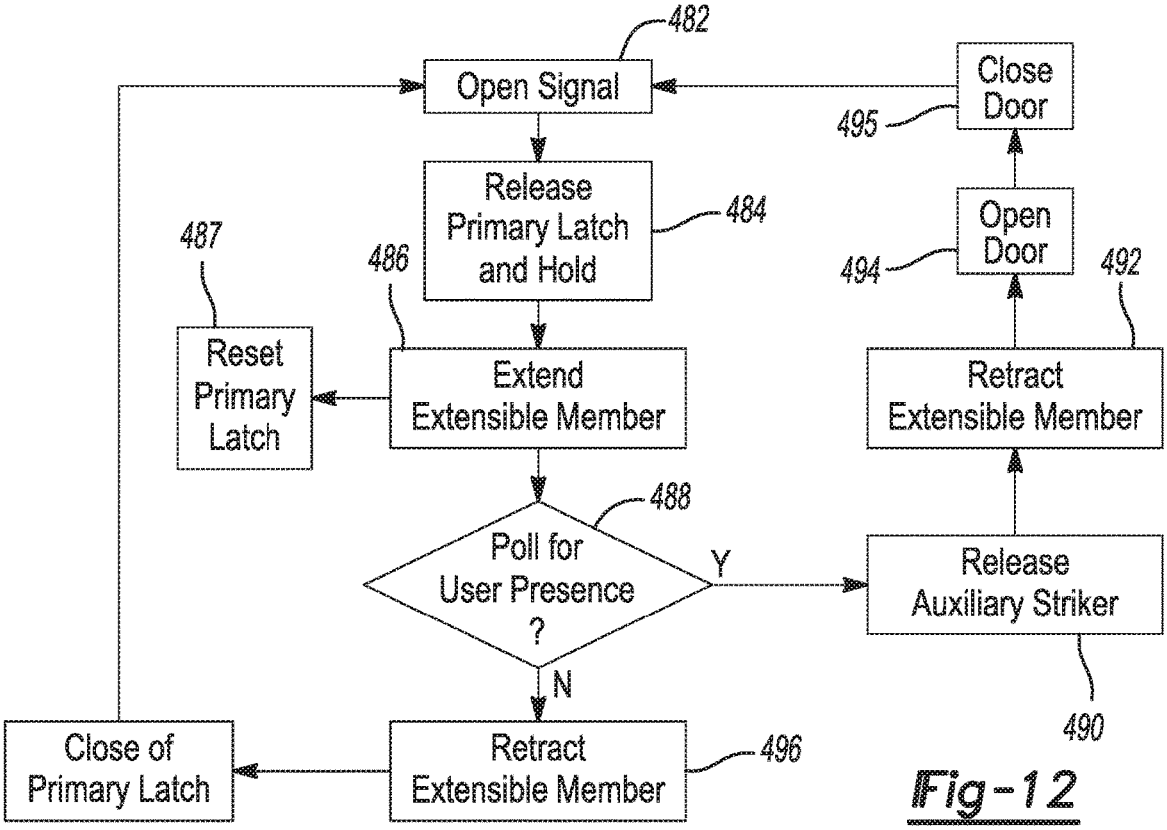
FIG. 12 is a flowchart for operation of the power door presenter system of FIGS. 8-10.

Referring to FIG. 12, a method for controlling operation of door presenter system 500 is disclosed. In particular, at step 482, swing door ECU 52 initiates door 12 opening by receiving an open signal (e.g. from key fob 60). It is recognized at this stage that primary latch assembly 13 remains latched until it is unlatched at step 484. At step 484, swing door ECU 52 (or other vehicle control module, ECU 67 for example) can release primary latch assembly 13 while holding primary latch assembly 13 in its unlatched state until resetting (at step 487) once striker 37 leaves the fishmouth. Holding the primary latch assembly 13 in the unlatched state allows the striker 37 to remain in the fishmouth of primary latch assembly 13 until extensible member 521 pushes striker 37 out of the fishmouth of primary latch assembly 13 due to further extension of the extensible member 521 in subsequent steps. At step 486, swing door ECU 52 can receive a signal (e.g. from sensors) that primary latch assembly 13 is unlatched (e.g. door 12 in the released or open position) and can send a signal to electric motor 514 to further actuate/extend extensible member 521 in order to present door 12 (e.g. opens door 12 an equivalent of approximately 50 mm at rear hem flange of the door 12). As part of step 486, once extensible member 521 begins extending, primary latch assembly 13 can send a signal e.g. (via door open switch 63) to swing door ECU 52 indicating that ratchet 21 has rotated to its striker release position and striker 37 is free from primary latch assembly 13, thus providing for resetting of primary latch assembly 13 at step 487 (e.g. swing door ECU 52 can send a signal to primary latch assembly 13 to reset power release motor 51 in order to facilitate movement of pawl 23 to return to its ratchet locking position). Also, at this time, swing door ECU 52 can start polling sensors (e.g. Adjustable Pressure Switch (APS) or other sensing technology) for manual opening of door 12 by the user and thereby continue checking throughout the extension of extensible member 521 at step 486.

At step 488, if the presence of the user is sensed by the sensors, e.g. customer inserts hand behind hem flange and presence of the customer's hand is detected via pressure on APS 63 or other sensing technology (the sensors can be preferably an anti-pinch strip type sensor that runs the periphery of the door and is activated by contact when manually grabbing door 12, however activation of any manual switch or via a capacitive, optical, ultrasonic, or other contact or non-contact sensor can also be used), swing door ECU 52 sends a signal at step 490 to unlatch power door presenter assembly 402, 502 from the auxiliary latch assembly 401, 501 on door 12 or vice versa (e.g. at any point during opening when the APS is activated)—see FIG. 12C. Once unhooked, the user can manually open door 12 at step 494 to a desired door check position and swing door ECU 52, at step 492, sends a signal to electric motor 514 to retract extensible member 521 back to its home position (e.g. retracted position), with hook 530 in its spring-biased home position, as the user is manually opening door 12. During normal operation, the extensible member 521 returns to the retracted position prior to closing of the door 12 by the user (for example, the power swing presenter return time is less than the time for a user to enter the vehicle and close the door) for ease of door closing. In the event that the extensible member 521 is not in the fully retracted position, the auxiliary latch system 501 will reengage with door presenter assembly 502 while the extensible member 521 continues to return to the retracted position.

Upon a normal closing operation of door 12 by the user at step 495, during engagement primary latch assembly 13 (to either the primary position, or secondary position if the cinch function is enabled), auxiliary striker 524 would once again become positioned at step 482 adjacent to extensible member 521. Accordingly, power door presenter system 500 is ready for reactivation at step 482.

If at step 488, if the user does not open door 12 manually after expiration of a pre-set time (i.e. the sensors do not detect that the user has manual control of door 12), swing door ECU 52 does not change the state of latch hook 530, latch hook 530 remains hooked/engaged with auxiliary striker 524, and swing door ECU 52 sends a retract signal to electric motor 514 in order to have extensible member 521 and latch hook 530 retracted pulling auxiliary striker 524 back towards its home position (e.g. non-extended state). As such, if at step 488 no signal (e.g. change of state) is received, then swing door ECU 52 at step 488 continues engagement of latch hook 530 with auxiliary striker 524, and signals at step 496 electric motor 514 to retract extensible member 521 (while latch hook 530 and auxiliary striker 524 are engaged) in order to pull door 12 to its secondary closed position, for example. At step 498, primary latch assembly 13 is closed and door 12 is returned to the primary closed position. Accordingly, power door presenter system 500 is ready for reactivation at step 482.

As discussed above, for inside operation of primary latch assembly 13 (e.g. using interior door handles by the user), activation of an inside handle switch (e.g. by the user) releases primary latch assembly 13 and also sends the signal to disengage hook 530/auxiliary striker 524 as discussed above with respect to door presenter system 400. As such, from the inside, the user opens door 12 like a conventional door (i.e. without extension of the power door presenter system 500), as door 12 presenter function of extensible member 521 is not used or, alternatively, the presenter function of extensible member 521 may be used to provide ice breaking functionality. In terms of manual closing of door 12, the user manually closes door 12 to secondary latch position (or slams to primary), in order for primary latch assembly 13 to lock door 12 (e.g. primary latch assembly 13 embodied as an e-latch cinches to the primary latched position). As such, hook 530 is reengaged with auxiliary striker 524 (e.g. using the spring bias towards engagement).

The power door presenter systems shown in FIGS. 5-10 provide an arrangement for providing a secondary or auxiliary latch assembly that is operable to maintain a latched relationship between the vehicle body and the vehicle door upon actuation of the door presenter assembly as the door moves from its closed position to its partially-open deployed position. The auxiliary latch assembly is subsequently released to permit movement of the door from its deployed position to its fully-open position. While not limited thereto, the door presenter assembly and the auxiliary latch assembly are capable of providing a range of swinging deployment of about 30-0 mm to meet current door system requirements. In addition, prior to release of the auxiliary latch assembly, the presenter assembly can be retracted from its deployed position to automatically return the door to its closed position (fully closed position or a secondary closed position if the primary latch assembly includes a cinch function). Additionally, the auxiliary latch assemblies are configured to automatically re-engage the presenter (i.e. re-latch) upon closing of the vehicle door.

Figure 13:
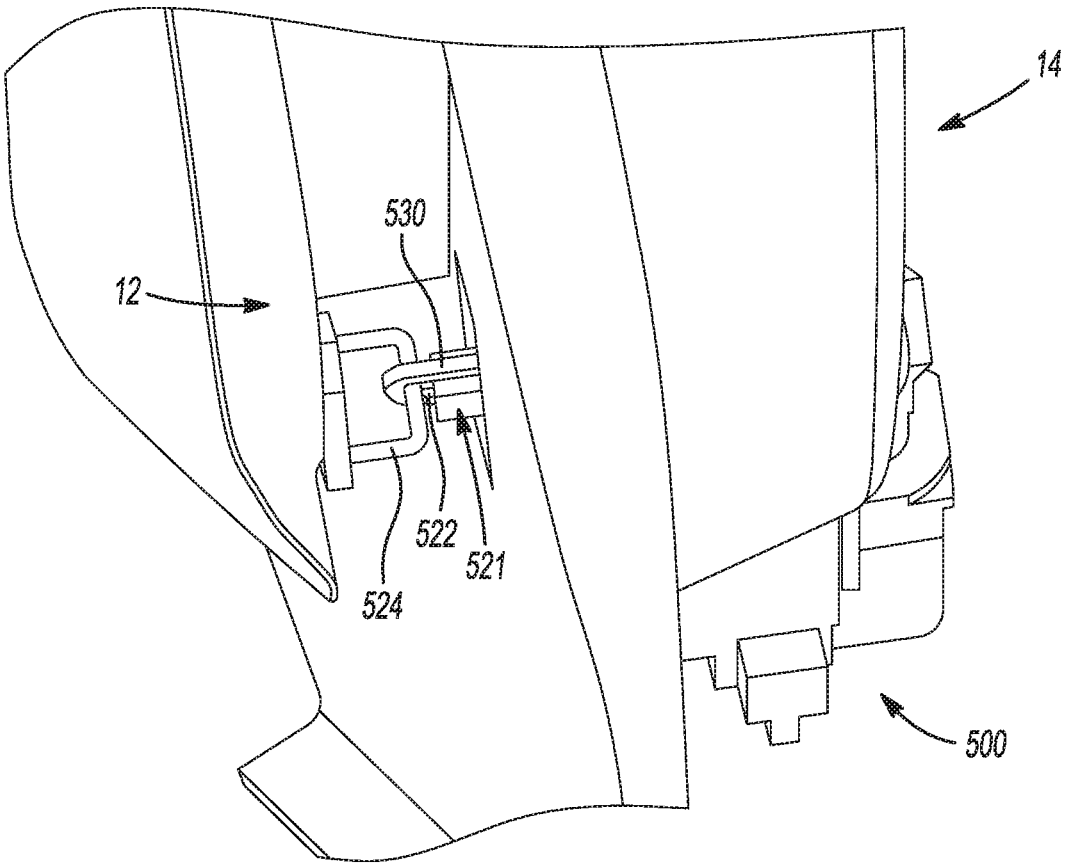
FIG. 13 is an example isometric view of the auxiliary latching mechanism associated with the power door actuation system of FIGS. 8-10.

FIG. 13 illustrates an embodiment of power door presenter system 500 with auxiliary striker 524 positioned adjacent to a distal end of door 12 near the hem flange and opposite hinges 16, 18. Latch hook 530 is shown engaged with auxiliary striker 524 with door 12 located in its presented position and prior to release of latch assembly 504.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A power door presenter system for a motor vehicle having a vehicle door moveable relative to a vehicle body between a closed position, a presented position, and a fully-open position, the system comprising:

a presenter assembly mounted to one of the vehicle body and the vehicle door, the presenter assembly including an extensible member moveable between a retracted position and an extended position, and a motor driven mechanism operable for powered movement of the extensible member, wherein powered movement of the extensible member between its retracted and extended position results in corresponding movement of the vehicle door between the closed position and the presented position;

a primary latch assembly mounted to the vehicle door and operable to releasably hold a primary striker mounted to the vehicle body when the vehicle door is located in the closed position, wherein the primary latch assembly is operable to release the primary striker prior to powered movement of the extensible member causing movement of the vehicle door from the closed position to the presented position; and an auxiliary latch assembly operably mounted to one of the extensible member and the other one of the vehicle body and the vehicle door and having a latch mechanism and a latch release mechanism, and an auxiliary striker engageable with the latch mechanism and operably mounted to the other one of the extensible member and the other one of the vehicle body and the vehicle door for preventing movement of the vehicle door from the presented position to the fully-open position when the latch mechanism is engaged with the auxiliary striker, wherein the latch release mechanism is actuatable for releasing the latch mechanism from the auxiliary striker so as to permit subsequent manual movement of the vehicle door by a user from the presented position to the fully-open position.

2. The power door presenter system of claim 1, wherein the auxiliary striker is held by the latch mechanism such that powered movement of the extensible member between its retracted and extended position results in corresponding movement of the vehicle door between its closed position and the presented position.

3. The power door presenter system of claim 1, wherein the auxiliary striker is mounted on the extensible member, and wherein the latch mechanism is mounted to the other one of the vehicle body and the vehicle door and includes a ratchet moveable between a striker capture position whereat the ratchet holds the auxiliary striker and a striker release position whereat the auxiliary striker is released, and a pawl moveable between a ratchet holding position whereat the pawl holds the ratchet in its striker capture position and a ratchet releasing position whereat the pawl permits the ratchet to move to its striker release position, wherein the latch release mechanism is actuated by the motor driven mechanism to move the pawl from its ratchet holding position into its ratchet releasing position, wherein the latch mechanism operates in a latched mode when the ratchet is located in its striker capture position for coupling the extensible member of the presenter assembly to the auxiliary latch assembly, and wherein the latch mechanism operates in an unlatched mode when the ratchet is located in its striker release position for uncoupling the extensible member of the presenter assembly from the auxiliary latch assembly.

4. The power door presenter system of claim 1 further comprising a control system for controlling release of the primary latch assembly in coordination with actuation of the motor driven mechanism.

5. The power door presenter system of claim 4, wherein the control system includes a sensor operable to detect when the vehicle door is under manual control of the user so as to control actuation of the latch release mechanism for releasing the auxiliary striker from the latch mechanism when the vehicle door is deployed to the presented position.

6. The power door presenter system of claim 5, wherein the auxiliary latch assembly further comprises a power-operated latch release actuator controlled by the control system for actuating the latch release mechanism.

7. The power door presenter system of claim 1, wherein the auxiliary latch assembly further comprises a manually-actuated release actuator for actuating at least one of the latch mechanism and the latch release mechanism for releasing the auxiliary striker from the latch mechanism in response to a manual input from the user.

8. The power door presenter system of claim 1, wherein the motor driven mechanism includes an actuator housing mounted to the vehicle body, an electric motor supported by the actuator housing, and a spindle drive unit having a rotary drive member rotatably driven by the motor, wherein rotation of the drive member in a first direction causes translation of the extensible member in a first direction from its retracted position toward its extended position, and wherein rotation of the drive member in a second direction causes translation of the extensible member in a second direction from its extended position toward its retracted position.

9. The power door presenter system of claim 8, wherein the extensible member is a drive nut in threaded engagement with the rotary drive member, and wherein the auxiliary striker is fixed to the drive nut.

10. The power door presenter system of claim 1, wherein the presenter assembly is mounted to the vehicle body, the auxiliary striker is mounted to the extensible member, and the latch mechanism is mounted to the vehicle door.

11. The power door presenter system of claim 1, wherein the auxiliary striker is mounted to the other one of the vehicle body and the vehicle door, wherein the latch mechanism is mounted to the extensible member and includes a latch hook mounted to the extensible member, wherein the auxiliary striker is moveable between a striker capture position whereat the latch hook holds the auxiliary striker and a striker release position whereat the auxiliary striker is released, and wherein the latch release mechanism is operable to move the auxiliary striker from its striker capture position to its striker release position.

12. The power door presenter system of claim 11 further comprising a control system for controlling release of the primary latch assembly in coordination with actuation of the motor driven mechanism.

13. The power door presenter system of claim 12, wherein the control system includes a sensor operable to detect when the vehicle door is under manual control of the user so as to control actuation of the latch release mechanism for releasing the auxiliary striker from the latch mechanism when the vehicle door is deployed to its presented position.

14. The power door presenter system of claim 13, wherein the auxiliary latch assembly further comprises a power-operated latch release actuator controlled by the control system for actuating the latch release mechanism.

15. The power door presenter system of claim 11 further comprising a manually-actuated striker release mechanism for disengaging the auxiliary striker from the latch hook in response to a manual input from the user.

16. The power door presenter system of claim 15, wherein the manually-actuated striker release mechanism is operable when the latch hook is located in the striker capture position to move the auxiliary striker to a position displaced from the latch hook.

17. The power door presenter system of claim 11, wherein the motor driven mechanism includes an actuator housing mounted to the vehicle body, an electric motor supported by the actuator housing, and a spindle drive unit having a rotary drive member rotatably driven by the motor, wherein rotation of the drive member in a first direction causes translation of the extensible member in a first direction from its retracted position toward its extended position, and wherein rotation of the drive member in a second direction causes translation of the extensible member in a second direction from its extended position toward its retracted position.

18. The power door presenter system of claim 11, wherein the presenter assembly is mounted to the vehicle body and the auxiliary striker is mounted to the vehicle door.

* * * * *